United States Patent [19]

Brandi et al.

[11] Patent Number: 4,482,274

[45] Date of Patent: Nov. 13, 1984

[54] FLOATING PLATFORM FOR USE IN DEEP WATERS, AND METHOD OF INSTALLATION

[75] Inventors: Roberto Brandi, Padua; Giovanni Bucaneve, Mestre; Antonio Della Greca, Mestre; Gaetano Sebastiani, Mestre; Francesco Toffano; Paolo Vielmo, both of Padua, all of Italy

[73] Assignee: Tecnomare, S.p.A., Venice, Italy

[21] Appl. No.: 281,372

[22] Filed: Jul. 8, 1981

[30] Foreign Application Priority Data

Jul. 15, 1980 [IT] Italy ..... 23442 A/80

[51] Int. Cl.[3] ..... B63B 35/44; E02B 17/00

[52] U.S. Cl. ..... 405/224; 114/265; 405/195

[58] Field of Search ..... 405/195, 224, 227; 166/350, 359, 367; 114/265

[56] References Cited

U.S. PATENT DOCUMENTS

| | | | |
|---|---|---|---|
| 3,934,528 | 1/1976 | Horton et al. | 405/224 X |
| 4,062,313 | 12/1977 | Stram | 114/265 |
| 4,188,156 | 2/1980 | Fisher et al. | 405/195 |
| 4,226,555 | 10/1980 | Bourne et al. | 405/224 |
| 4,257,720 | 3/1981 | Ostgaard | 405/227 |

*Primary Examiner*—David H. Corbin

*Attorney, Agent, or Firm*—Hedman, Gibson, Costigan & Hoare

[57] ABSTRACT

A floating platform used in exploiting subsea oil shoals and a method for installing the platform which comprises a platform structure and an array of vertical tubular anchoring lines connected to the uprights of the platform and to anchoring blocks lying on the sea bottom, the tube sections which form the anchoring lines being connected together in sequential order by welding to make up a solid entity.

13 Claims, 11 Drawing Figures

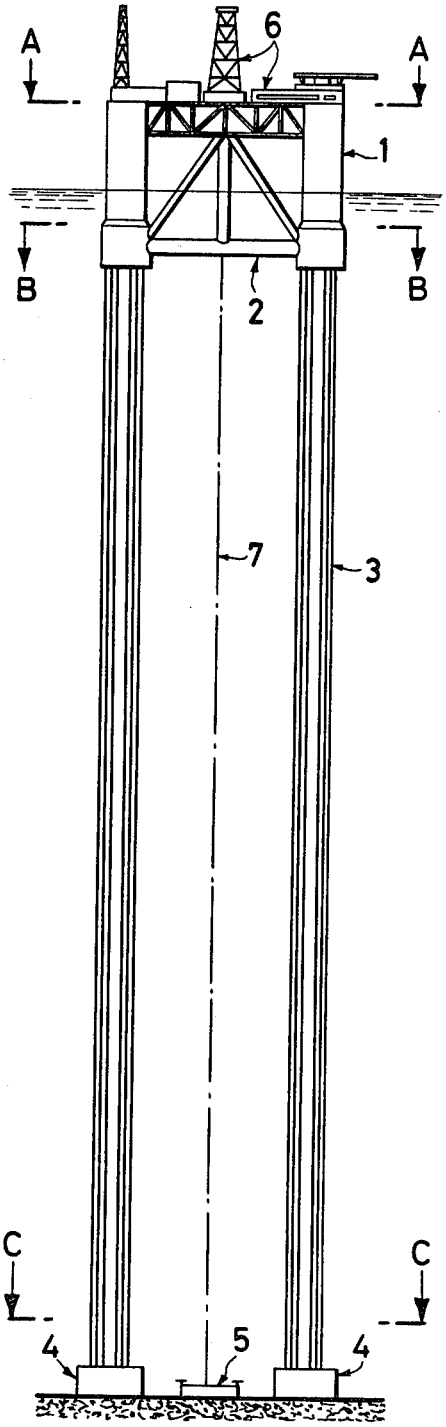
Fig.1
Fig.1A
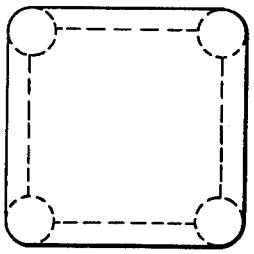
Fig.1B
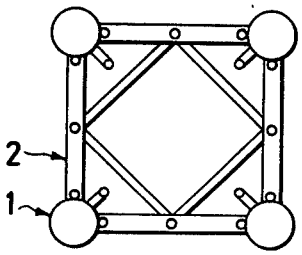
Fig.1C
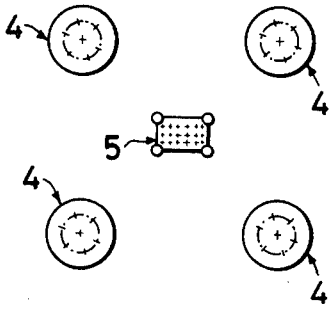

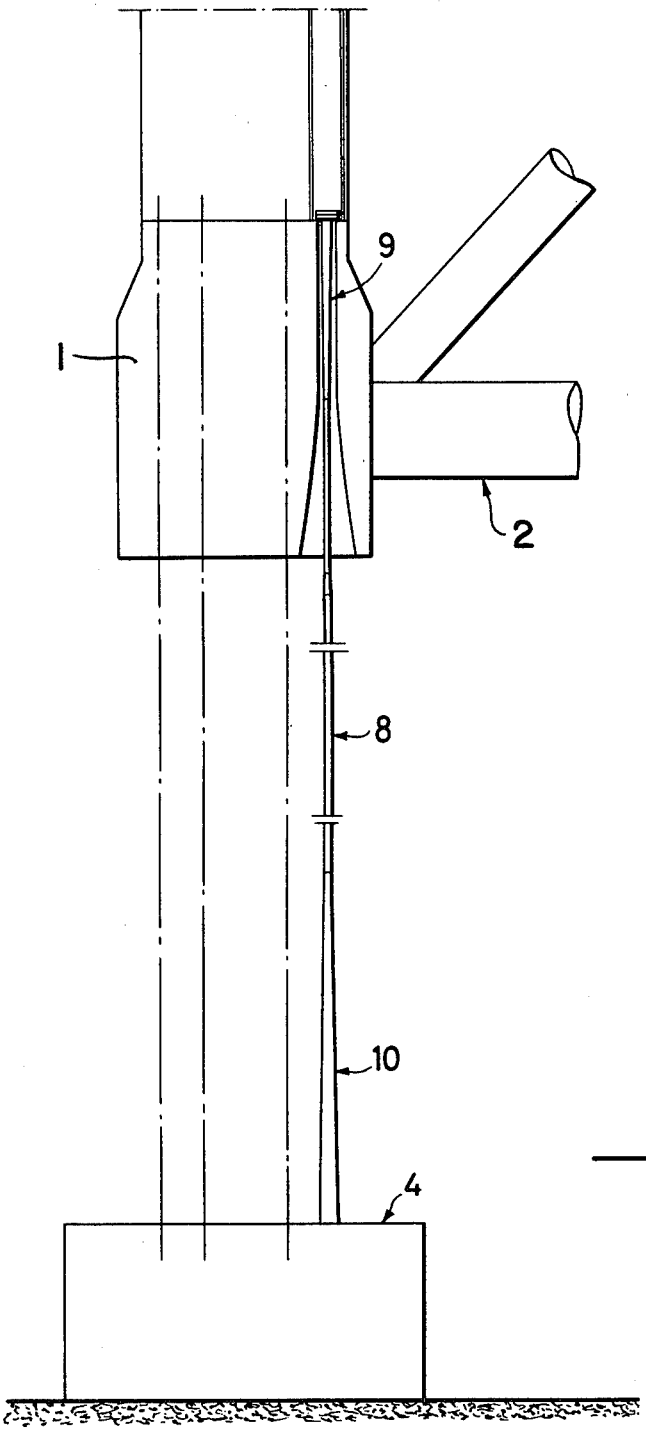
Fig.2
Fig.2A
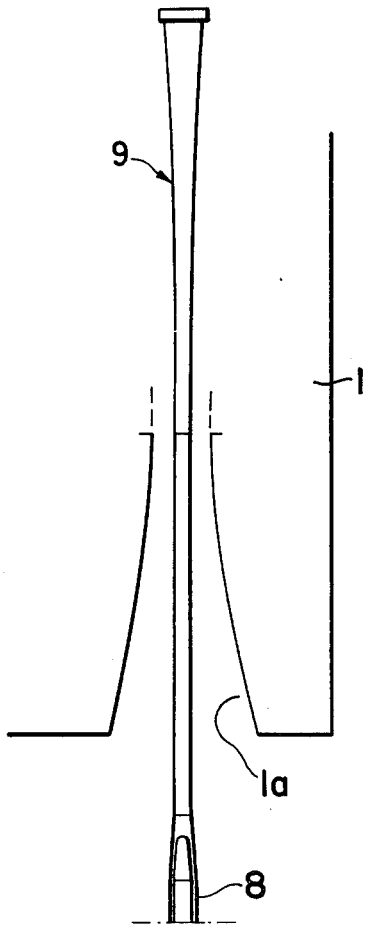

FLOATING PLATFORM FOR USE IN DEEP WATERS, AND METHOD OF INSTALLATION

The present invention relates to a floating platform intended for industrial uses and more particularly for drilling and producing oil in oil shoals situated in deep waters, wherein the platform is partially immersed and held in position a number of vertical anchoring lines held taut and including tubular structural members secured to anchoring blocks positioned on the sea bottom.

In exploiting oil shoals in deep waters (more than 300 meters), the floating platform anchored by taut, vertical anchoring members can advantageously replace the fixed platform. A few modifications of this basic idea already have been suggested. However, a floating platform anchored by vertical cables or ropes held taut has the following limitations and shortcomings:

- it cannot reach deep waters beneath 500 meters because the jerking and pitching periods of the structure grow too long;
- it cannot bear very high payloads, and
- it contains, as the critical and essential structural components, the anchoring cables, the behaviour of which is not sufficiently known, so that periodical replacement is required.

In addition, a floating platform anchored by tubular members connected together by mechanical linking elements, such as by screw threads or spherical joints, has the defects of relatively high initial costs and poor reliability of mechanical components which must be inspected and replaced whenever necessary.

The platform made according to the present invention overcomes the foregoing defects

- by having anchoring members comprising simple tubes welded and restrained at their base end to the sea bottom, thereby avoiding reliability and fatigue life problems, inasmuch as the platform does not contain mechanical components or any intricate structural modes;
- by having pitching and jerking periods of its own which are comparatively short; thereby having a dynamic behaviour which is good up to typical depths of about 1000 meters;
- by being able to have heavy payloads even when the weather is exceptionally rough;

In general, the platform of the invention includes:

- a number of vertical uprights
- a deck structure for carrying the installation
- a horizontal base structure
- vertical and sub-vertical components which connect the horizontal base structure to the deck
- vertical anchoring tubes which connect the Nc uprights to as many anchoring blocks positioned on the floor of the water
- a number of anchoring blocks
- one or more vertical production conduits which connect the subsea implements (well heads and allied implements) to the installation placed on the platform deck.

The invention will now be described in detail with reference to a preferred configuration having 4 uprights and 4 anchoring blocks as shown in the FIGS. from 1 to 7 of the accompanying drawings.

FIG. 1 is a side elevational view of the floating platform in its operative position and FIGS. 1A, 1B and 1C are cross-sectional views taken at three different levels.

FIG. 2 is a side elevational view which illustrates the configuration of an anchoring line and FIG. 2A is an enlarged side elevational view of the bottom of the upright and the top of an anchoring line;

Figure 3:
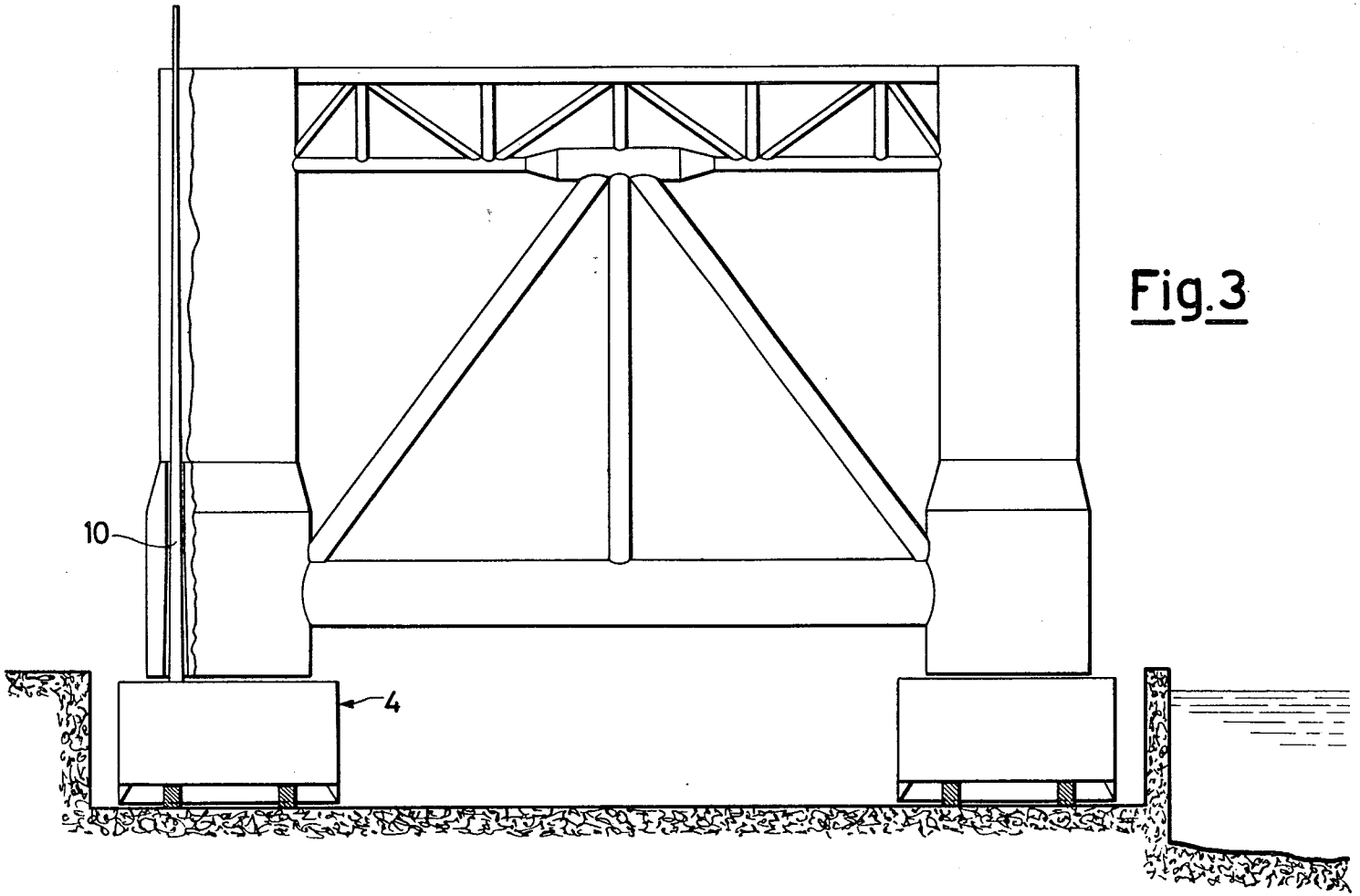
FIG. 3 illustrates the platform under construction.

Referring to the drawings, the illustrated hull essentially comprises the bottom section of the uprights 1 and the horizontal base structures 2. The anchoring assembly is composed of four bundles of anchoring lines, 3, each of which connects an upright 1 to its respective anchoring block 4 laid on the sea bottom.

A structure anchored in this manner can be shifted laterally and can be rotated about a vertical axis. The jerking and pitching motions are nearly entirely hindered by the axial stiffness of the bundles of anchoring tubes 3: these latter are held taut by the platform as a whole which, in the position shown, has a buoyancy greater than its own weight.

The connection between the oil-extracting system of the subsea wells 5 and the machinery installed on the deck 6 is embodied by one or more production pipes 7.

In FIG. 2 the configuration of an anchoring line 3 is shown. The line 3 is composed of a steel tube 8 having a satisfactory resistence to yield stresses, and its ends are appropriately shaped, to wit:

The top end 9 is a downwardly tapered, solid steel rod having a flexural stiffness which decreases starting from the point of connection to the structure of the upright 1 and is such as to limit the bending stresses originated by the horizontal shifts of the floating body to a certain magnitude.

For most severe weather conditions, and thus in a limited number of cases, said structural member 9, if the lateral shifts are important, is sustained by the specially provided bell shaped supporting member 1 which matches the curvature thereof (FIG. 2A). By so doing, wide angles of incline of the anchoring lines 3 can be attained while restricting the bending stresses thereon. As shown, the upright 1 includes a bore 1*a* for the anchoring line, the walls of which define the flared bell shaped structure. In the illustrative embodiment the walls which define the bore 1*a* are flared outwardly and downwardly so that the larger end is at the lower end of the upright.

The bottom end 10 is so designed as to withstand in a fully reliable manner the maximum bending stress originated by the maximum shift of the floating structure. It has a hollow tapered configuration with a maximum cross section at its lower fixed end which is on the anchoring block 4 in order to achieve optimum exploitation of the structural material.

FIG. 3 shows the platform during progress of its construction in a shipyard. The constructional step sequence comprises:

- construction of the anchoring blocks 4 and of the bottom section of the anchoring lines, 10,
- construction of the anchoring section for the platform and the deck by adopting the usual procedure and typical implements, pumping water in the dry dock and launching the assembly of the platform and the anchoring blocks.

The structure which floats on its anchoring blocks is towed to still waters. The anchoring blocks are flooded and the machinery is installed on the deck. As an alternative, the deck can be installed on the platform in a single step: the platform is sunk partially by an appropriate ballast system and only a portion of the uprights is allowed to emerge above the water level; the completed deck with the machinery thereon is towed, either afloat or on pontoons, above the platform, whereafter the latter is caused to emerge again and is structurally connected to the deck.

Figure 4:
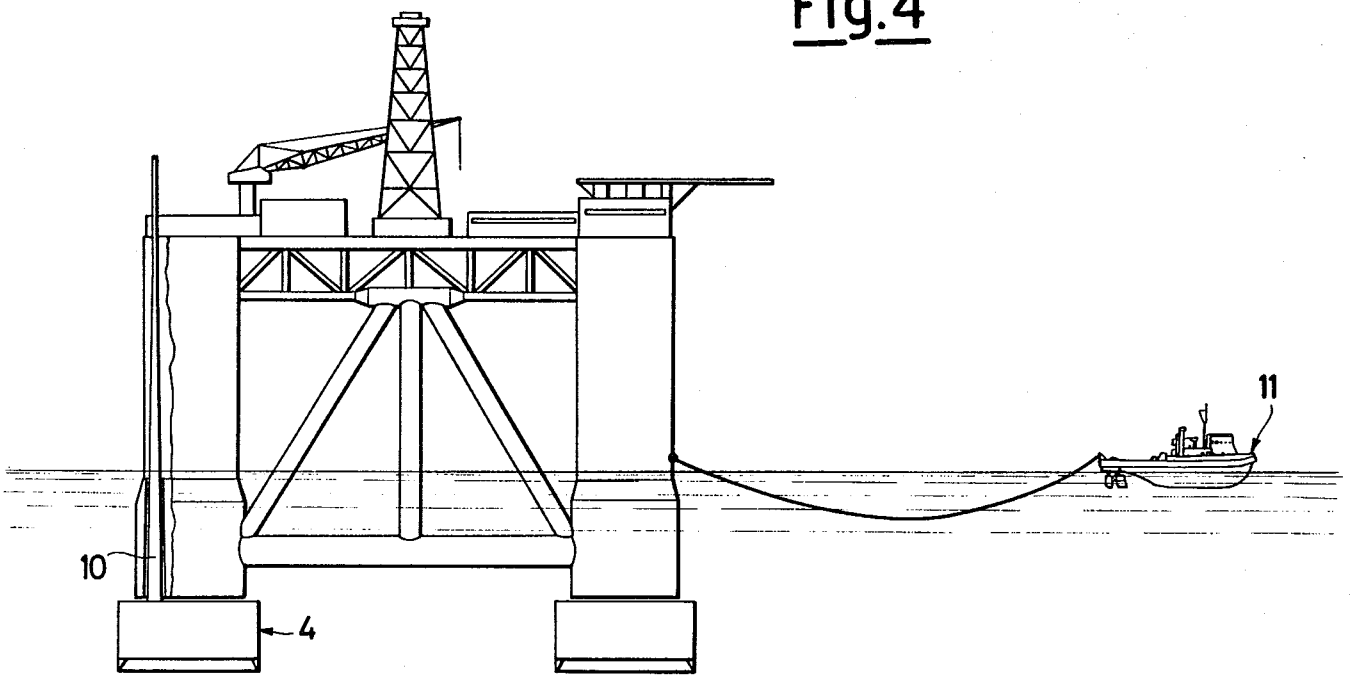
FIG. 4 illustrates the completed platform being towed.

FIG. 4 shows the platform completed with its machinery and conveying its anchoring blocks which have been flooded and connected to the structure by the agency of the bottom ends of the anchoring lines 10, the platform being towed to the operations area by one or more tugboats 11.

Once the operation area is reached, the platform is anchored by a temporary catenary anchorage.

Figure 5:
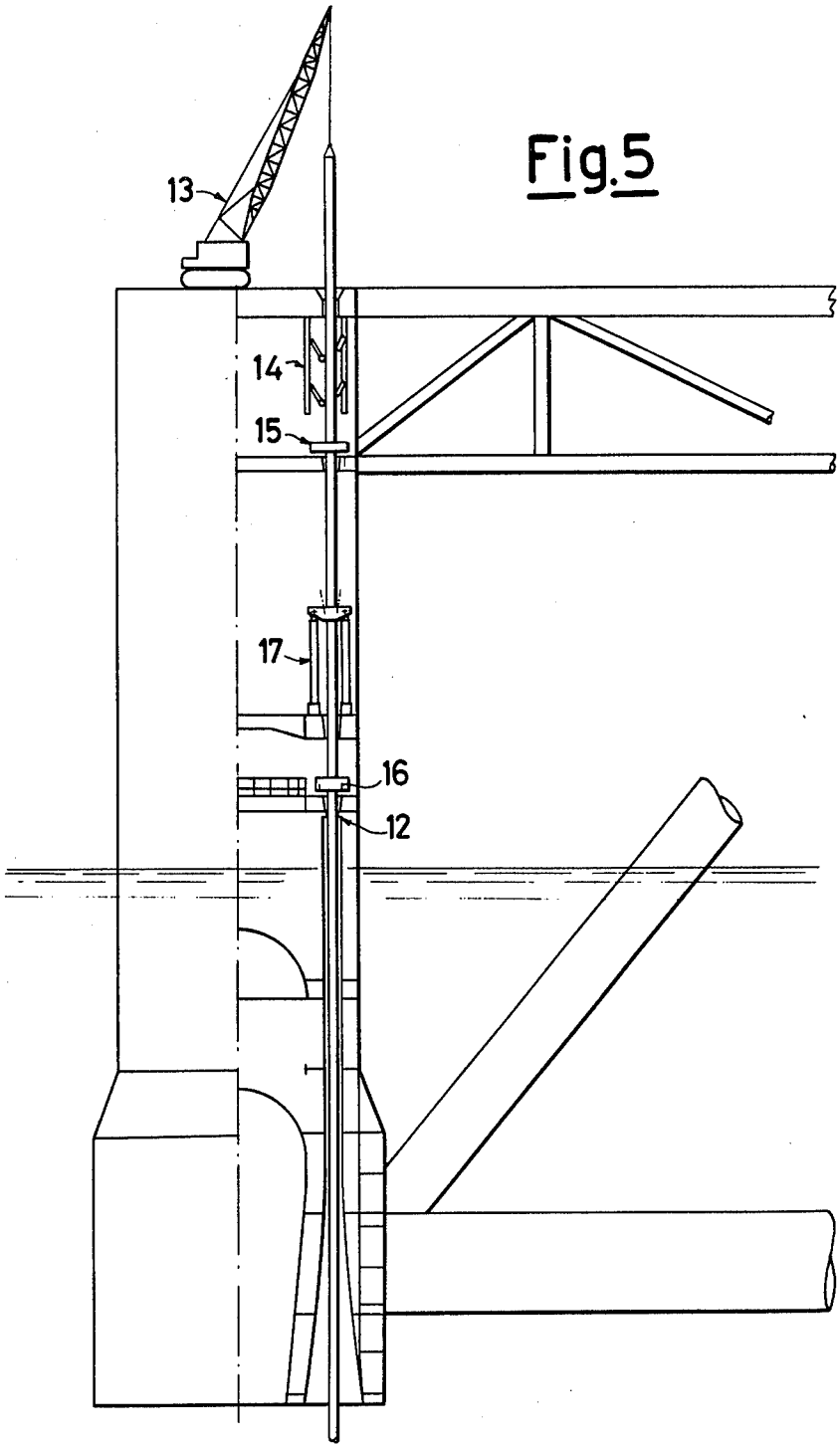
FIG. 5 illustrates the launching of the anchoring lines.

FIG. 5 shows the launching procedure for the anchoring lines, one section after another.

The first portion of each anchoring line 3 is already connected to the bottom end, so that the launching of the first sections is carried out at one time. The section which has already been launched is held in position by a pincer 12. The next sections are positioned by the swinging crane 13 into the specially provided guiding implement 14 and centered by an internal centering tool. The connection between a section and its next is carried out by a speedy and reliable welding procedure.

Downstream of the welding station 13 is a station 16 for checking the welding seams and for the possible repair thereof.

Once all the anchoring lines 3 have been welded, they are simultaneously lowered by hydraulic ram mechanisms 17 which are all actuated at one time. On completion of the launching of the anchoring lines 3, the anchoring blocks 4 lie on the sea bottom.

Figure 6:
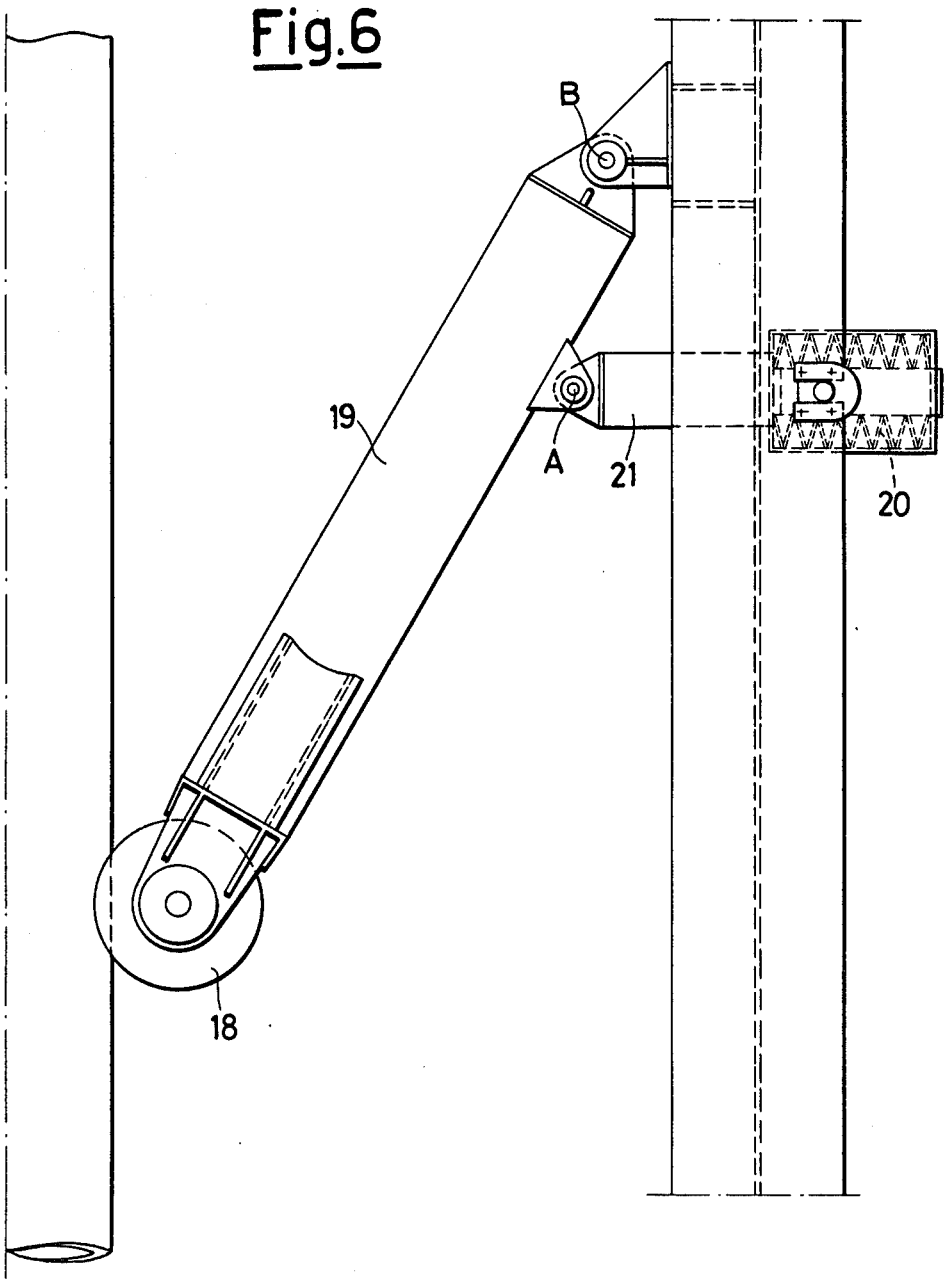
FIG. 6 illustrates a guiding implement for the anchoring lines.

The guiding implement 14 (FIG. 6) includes three rollers, 18, which are connected to as many tubular members 19 pivoted at A and B.

The resilient members 20 act upon the centering implements 21 to provide the necessary contacting force between the rollers 8 and the portion of anchoring lines 3 being positioned.

Figure 7:
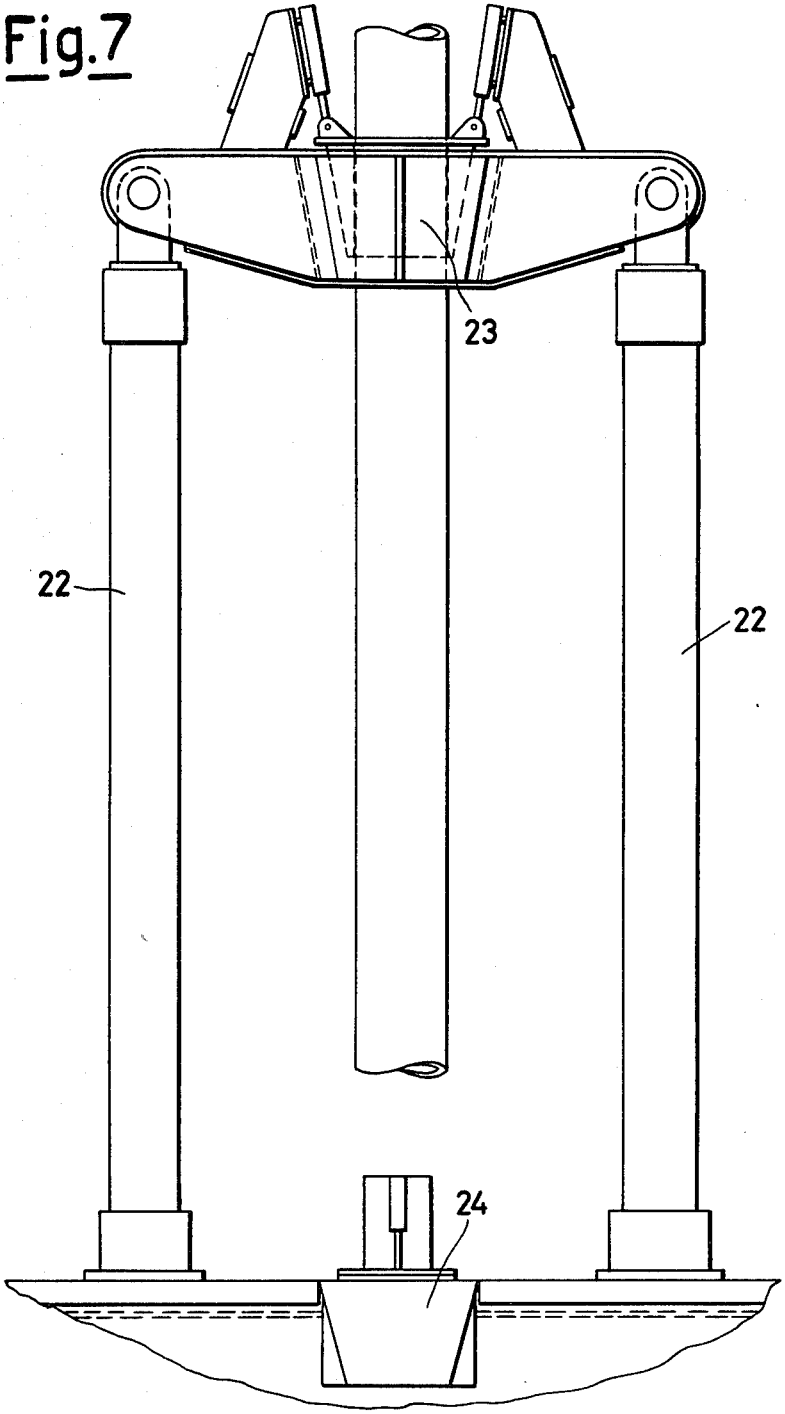
FIG. 7 illustrates a hydraulic mechanism for the anchoring lines.

The hydraulic ram mechanisms 17 include (FIG. 7) two jacks, 22, a movable latching member or movable pincer 23 and a fixed latching member, or fixed clamp 24.

During the upward stroke of the jacks 22, the fixed clamp 24 latches onto the already launched anchoring line 3. On completion of said stroke the movable pincer 23 is actuated whereas the fixed clamp 24 is deactivated to enable the jacks 22 to effect their downward strokes.

The sequential order of these steps enables all the anchoring lines 3, and thus their attendant blocks 4 to be lowered simultaneously.

To place the platform in its safety position, the anchoring blocks 4 are filled with a solid ballast having an appropriate specific gravity with the strain in the several anchoring lines 3 being equalized and the top terminals 9 of the anchoring lines 3 secured to the platform structure. If desired, the ballast can be fed through the lines 3 into the blocks 4.

The anchoring lines 3 are then prestressed to the desired value by dumping the liquid ballast out of the ballast tanks of the platform hull 1.

We claim:

1. A platform which floats in a body of water, comprising:

a platform having uprights with bores therein, the walls of which are bell shaped with the larger flared ends thereof at the lower ends of said uprights, anchoring blocks on the sea bottom, and anchoring lines connected at one end to said uprights and at the other end to said anchoring blocks wherein said anchoring lines are kept under a pulling stress by an excess of buoyancy of said platform, and wherein each of said anchoring lines comprises a steel tube having:

a hollow tapered bottom section secured to an anchoring block with its maximum diameter at said block, a hollow central section of an essentially uniform diameter connected at its lower end to the upper end of said bottom section,, a solid and tapered top section extending through a bell shaped bore in said upright and normally spaced from the outwardly flared walls defining said bore with the maximum diameter of said top section being at the point of connection to said upright, with its minimum diameter at the lower end thereof connected to said central section, and with a decreasing flexural stiffness there between, and the space between the outwardly flared wall defining said bore and said tapered top section being sufficient to allow limited movement of said section until it bears against said outwardly flared wall, whereupon said walls limit further movement of and bending stresses on said anchoring line.

2. The platform of claim 1, wherein said sections are welded together and formed from structural steel.

3. A method for installing a floating platform including uprights with bores therein which have outwardly flared walls with the larger ends at the lower ends of the uprights, anchoring blocks for placement on the sea bottom and anchoring lines therebetween in the form of steel tubes having a tapered top, uniform central and tapered bottom sections, comprising:

securing each bottom section of the tube to the anchoring blocks with the end of maximum diameter at the block, launching the anchoring blockings from the platform while holding the bottom sections secured thereto, welding a segment of the central section to a bottom section and thereafter welding additional segments of the uniform central section to each other while holding the welded portion of the tube, welding the tapered top section of each tube to the central section with the end of minimum diameter welded to the uniform central section, while the welded portion of the tube is being held, and lowering the welded tubes in the body of water until the anchoring blocks are on the sea bottom and the larger ends of the top sections of the tubes are connected to the uprights.

4. The method according to claim 3, wherein upon completion of the launching of the anchoring blocks and the welding anchoring lines, the blocks are filled with a solid ballast material introduced through anchoring lines, to safely place the platform.

5. A platform which floats in a body of water having uprights with bores therein, anchoring blocks adapted to be on the sea bottom and anchoring tubes adapted to be connected therebetween, wherein each tube has an upper section for connection to an upright, a bottom section connected to an anchoring block and intermediate sections connected to each other and to said top and bottom sections, comprising:

means connected to said uprights for towing the platform in water to a desired area with the bottom sections of said tubes connected to said anchoring blocks and extending into the bores of said uprights to position said anchoring blocks adjacent thereto, means on the platform for sequentially lowering unattached sections of said tubes into said bores to the sections of said tubes therebelow, guiding means in said uprights about said bores for centering each unattached lowered section of said tubes within its bore adjacent to sections of said tubes therebelow, welding means in said uprights about said bores positioned adjacent to the lowered and guided unattached section of said tubes for welding said section to the adjacent section therebelow, gripping means in said uprights about said bores for releasably holding the welded sections of tubes while said unattached section immediately thereabove is being welded thereto, lowering means for gripping and lowering welded sections of tubing until said anchoring blocks are on the sea bottom, said upper sections of said tubes being positioned within said bores when said anchoring blocks are on the sea bottom and having means therein for connecting said tubes to said uprights, and said platform having an excess of buoyancy whereby said tubes of welded sections connected to said uprights and anchoring blocks are kept under tension.

6. The platform of claim 5, wherein a second welding means is provided in said bores in said uprights downstream of said first welding means for additional welding of sections of said tubes when necessary.

7. The platform of claim 5, wherein said guiding means are upstream of said first welding means, said first welding means are upstream of said lowering means, and said lowering means are upstream of said gripping means.

8. The platform of claim 5, wherein said guiding means include rollers about and extending into said bores for contact with each section of tubes to be centered therein, members pivotally connected to said uprights and on which said rollers are rotatably mounted, and centering means connected to an intermediate portion of said members and said uprights which urge said rollers into contact with sections of said tubes for the centering thereof.

9. The guiding means of claim 8, wherein said centering means include resilient means for constantly urging said rollers into contact with sections of said tubes.

10. The lowering means of claim 5, wherein the lowering means include reciprocating hydraulic jacks mounted within said uprights and about said bores, a movable latching member connected to and extending between said jacks for gripping the welded sections of said tubing only when said jacks are moved downwardly for lowering said sections, and a fixed latching means through which said sections extend for gripping and holding them upon the release of said movable latching member and only when said jacks are moved upwardly.

11. The platform of claim 5, wherein the walls of said bores are bell shaped with the larger flared ends thereof being at the lower end of said uprights, and wherein each of said tubes includes:

a tapered bottom section secured to said anchoring block with its maximum diameter at said block, a central section of an essentially uniform diameter connected at its lower end to the upper end of said bottom section, a tapered top section extending through a bell shaped bore in said upright and normally spaced from the outwardly flared walls defining said bore with the maximum diameter of said top section being at the point of connection to said upright and with its minimum diameter at the lower end thereof connected to said central section, and the space between the outwardly flared wall defining said bore and said tapered top section being sufficient to allow limited movement of said section until it bears against said outwardly flared wall, whereupon said walls limit further movement of and bending stresses on said tube.

12. The platform of claim 11, wherein each of said tubes are formed from steel and include hollow bottom and central sections, and a solid top section with a decreasing flexural stiffness from the point of connection with said upright.

13. The platform of claim 11, wherein said sections are welded together and are formed from structural steel.

* * * * *